US005532422A

United States Patent [19]

Chang

[11] Patent Number: 5,532,422

[45] Date of Patent: Jul. 2, 1996

[54] ROTATION-DRIVEN STRUCTURE FOR MUSIC BOX

[76] Inventor: Chih-Ping Chang, No. 112, Lane 1008, Ming-Hu Road, Hsinchu, Taiwan

[21] Appl. No.: 202,288

[22] Filed: Feb. 25, 1994

[51] Int. Cl.[6] ..... G10F 1/06

[52] U.S. Cl. ..... 84/95.1; 84/95.2; 446/298

[58] Field of Search ..... 84/95.1, 95.2, 84/94.1, 94.2; 446/265, 298; 40/457, 455, 456

[56] References Cited

U.S. PATENT DOCUMENTS 5,110,636 5/1992 Hou ..... 84/95.2

5,134,795 8/1992 Wang ..... 84/95.2

5,339,923 8/1994 Chen ..... 84/95.2

*Primary Examiner*—Cassandra C. Spyrou

*Attorney, Agent, or Firm*—Notaro & Michalos

[57] ABSTRACT

A rotation-driven structure for a music box is disclosed. The structure generally includes a music generator, a driving disc, a transmission cap, a housing, a cover, and a plurality of planetary discs. The music generator produces music and employs the driving disc and the transmission cap to transmit driving force originating from the music generator to rotate the housing and the cover simultaneously so that the rotations of the cover and the planetary discs rotate reversely to each other.

3 Claims, 5 Drawing Sheets

ROTATION-DRIVEN STRUCTURE FOR MUSIC BOX

FIELD OF THE INVENTION

The present invention relates generally to a music box and more particularly to a rotation-driven structure for a music box.

BACKGROUND OF THE INVENTION

Music boxes produce music and rotational motions of dolls thereon. The conventional music box provides only one direction rotation which is dull and not attractive to the customer. Thus, a music box having more rotating manners is expected to create more additional values.

SUMMARY OF THE INVENTION

Accordingly, it is a primary object of the present invention to provide a rotation-driven structure of a music box that overcomes the problem of the prior art.

It is another object of the present invention to provide a rotation-driven structure for a music box which generally includes a music generator, a driving disc, a transmission cap, a housing, a cover, and at least a planetary disc. The music generator produces music and employs the driving disc and the transmission cap for transmitting driving force originating from the music generator to rotate the housing and the cover simultaneously so that the cover and the planetary discs rotate reversely to each other.

The above objects, features and advantages of the invention will become readily apparent from the following detailed description thereof which is to be read in connection with the accompanying drawings.

DETAILED DESCRIPTION OF THE PREFERRED EMBODIMENT

Figure 1:
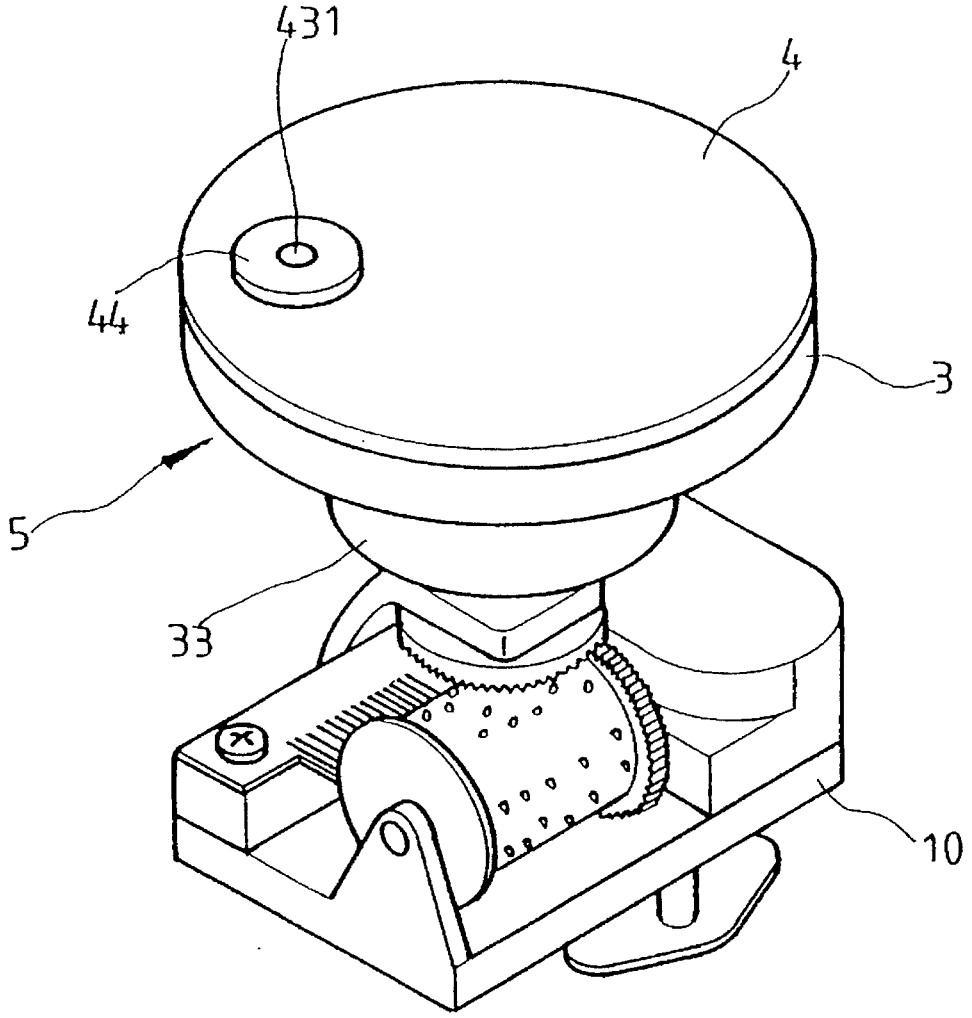
FIG.1 is a perspective view of a rotation-driven structure for a music box in accordance with a first embodiment of the present invention.
Figure 2:
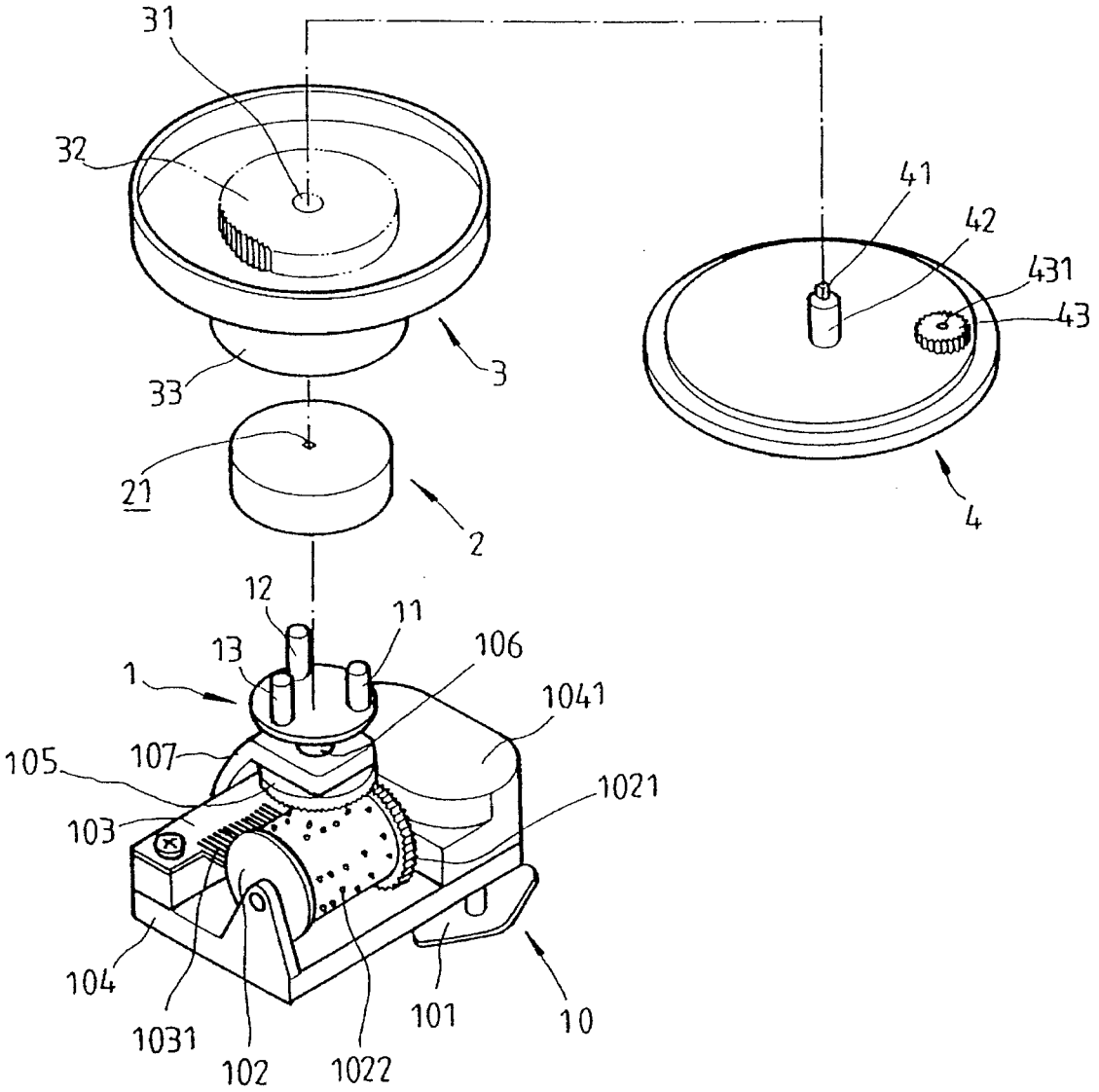
FIG.2 is an exploded perspective view of the rotation-driven structure of FIG. 1.
Figure 3:
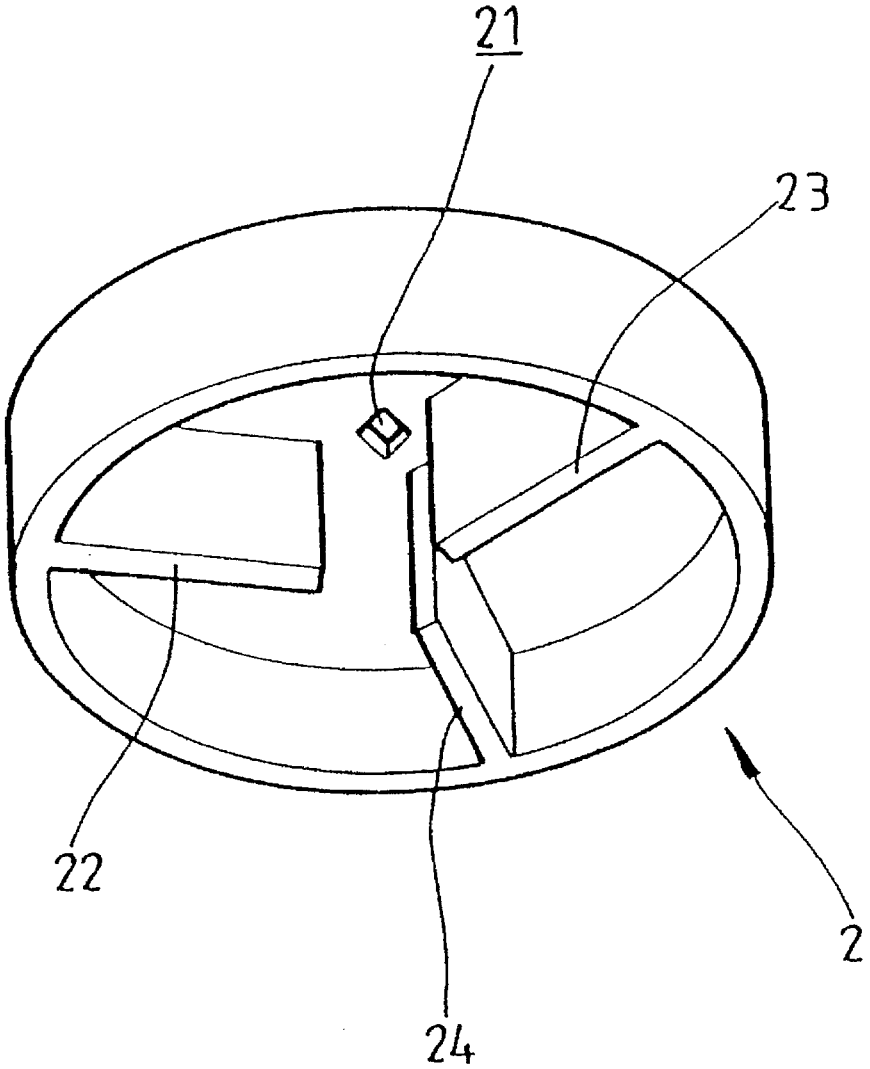
FIG.3 is a bottom view of a transmission member of the music box rotation-driven structure of FIG. 1.

Referring to the drawings and in particular to FIGS. 1 and 2, which show a first embodiment of the present invention, a rotation-driven structure for a music box assembly constructed in accordance with the present invention includes a music generator 10, a driving disc 1, a transmission cap 2, a gear box 5 having a housing 3 and a cover 4, and a planetary disc 44. The music generator 10 produces music and employs the driving disc 1 and the transmission cap 2 for transmitting driving force originating from the music generator 10 to rotate the housing 3 and the cover 4 simultaneously.

The music generator 10 which is generally known to those skilled in the art includes a seat 104 having a casting 1041 for receiving therein spring-driving means which are not shown in the drawings, a metal plate 103 which is secured to the seat 104 and having a plurality of reeds 1031 extending therefrom, a roller 102 which is rotatably supported by the seat 104 and having a gear 1021 coaxially formed at one end thereof and a plurality of projections 1022 formed and arranged therearound to hit the reeds 1031 in a scheduled way to make music when the roller 102 rotates, screwing means 101 to screw up the spring-driving means to rotate the roller 102, a horizontal converting gear 105, which is engaged with the gear 1021, a shaft 106, and a mount 107 secured on the seat 104, wherein the shaft 106 rotatably extending through the mount 107 to drivingly connect the converting gear 105 to the driving disc 1 to transmit the rotation of the roller 102 to the driving disc 1.

Figure 4:
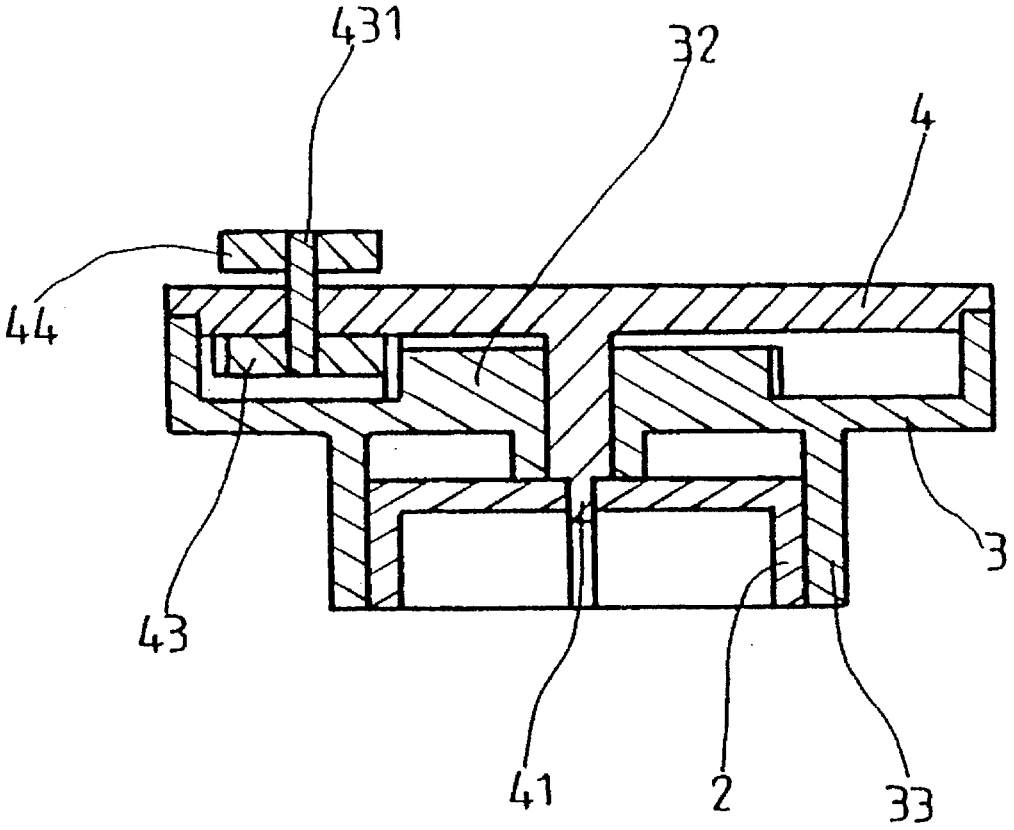
FIG.4 is a cross-sectional view of an upper portion of the rotation-driven structure including the transmission member in FIG. 3, a housing and a rotating disc.

Referring to FIGS. 2 and 4, the driving disc 1 has a plurality of posts, for example, three cylindrical posts, 11, 12, and 13, extending upward therefrom. The transmission cap 2 has a polygonal hole 21 on a top thereof and a plurality of plates, for example, three plates, 22, 23, and 24, preferably arranged therein and radially extending inward therefrom to define therebetween a plurality of interior spaces to receive therein the posts 11, 12, and 13 respectively. The housing 3 has a side wall 33 formed therebelow to loosely receive therein the transmission cap 2 and a sun gear 32 with a central hole 31 formed thereon.

The cover 4 has on a bottom side thereof a first axle 42, which is secured thereto in the center thereof and rotatably receivable within the hole 31 of the housing 3, having a polygonal end shaft 41 therein extending therefrom to be drivingly received within the corresponding polygonal hole 21 of the transmission cap 2, and a planetary gear 43 having an axle 431 rotatably extending through and supported by the cover 4. On a top of the cover 4, a corresponding planetary disc 44 is secured to the planetary gear 43 via the planetary axle 431 to be rotatable in unison therewith.

When the roller 102 is driven by the spring-driving means and music is generated, the rotation of the driving disc 1 which is driven by the gear 105 through the shaft 106 rotates the cover 4 about the first axle 42 by the pushing force applied by the posts 11, 12, 13 of the driving disc 1 to the plates 22, 23, 24 of the transmission cap 2. Simultaneously, the planetary gear 43 is rotated with the cover 4o Also, due to the engagement of the planetary gear 43 with the stationary sun gear 32 of the housing 3 which is firmly attached to an external container (not shown in the drawings) and thus stationary, the planetary gear 43 is driven to rotate about the planetary axle 431. Thus, the planetary disc 44 is driven by the planetary gear 43 to rotate in the same direction.

In accordance with the present invention, the cover 4 and the planetary disc 43 may have attached thereon lovely decorations, such as dolls which will have rotations in different ways, to draw customers' attentions.

Figure 5:
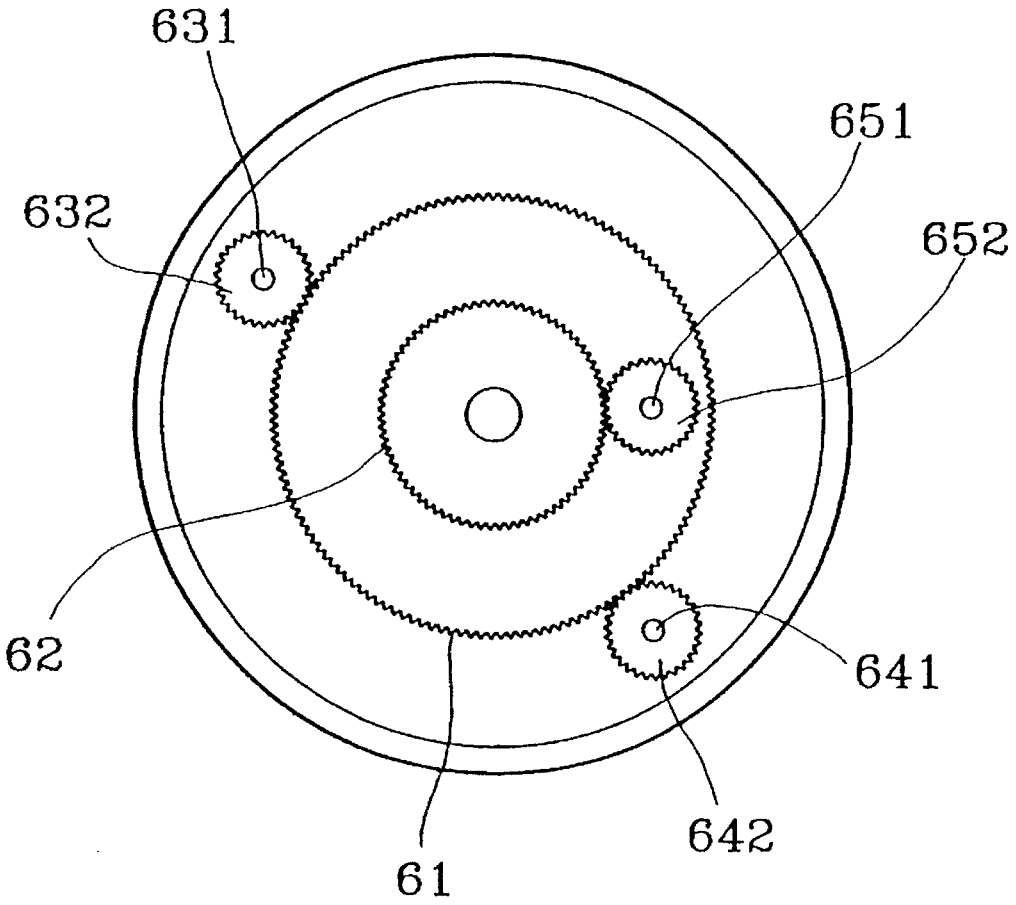
FIG.5 is a top view showing the arrangement of gears within the housing of the present invention in accordance with a second embodiment thereof.

A second embodiment of the present invention is shown in FIG. 5, which comprises two sun gear 61, 62, which are formed in the bottom of the housing 3, preferably have different diameter and located at different altitudes so as not to interfere each other. Correspondingly, a plurality of planetary gears, for example, three planetary gears 632, 642, 652 formed on the cover 4 have three corresponding planetary discs (not shown in FIG. 5) secured thereto on the other side and three corresponding axles 631, 641, 651 drivingly connected between the planetary discs and the planetary gears respectively. The first two of the planetary gears 632, 642 are engaged with the first sun gear 61 and the third one of the planetary gear 652 is engaged with the second sun gear 62 so that the planetary discs can perform a movement with the rotation of the cover 4 about the first axle 42 and simultaneously a rotation about their own axles 631, 641, and 651.

Having described the specific preferred embodiments of the present invention with reference to the accompanying drawings, it will be appreciated that the present invention is not limited to that precise embodiments and that various changes and modifications can be effected therein by one of ordinary skill in the art without departing from the scope or spirit of the invention as defined by the appended claims.

What is claimed is:

1. A rotation-driven structure for a music box comprising a music generator having a seat; a gear, which is rotatably supported by a shaft on a mount secured to the seat and drivingly engaged with said music generator; a driving disc having a plurality of posts extending therefrom, wherein said driving disc is secured to said shaft to be rotatable in unison with said gear; a transmission cap having a first hole formed thereon and a plurality of plates arranged therein and radially extending therebetween to define a plurality of interior spaces to correspondingly receive therein said posts respectively; a housing having a circumferential side wall formed therebelow rotatably receiving said transmission cap, at least a sun gear being formed on said housing with a second hole formed in center thereof; a cover including a first axle mounted thereto being rotatably received within said second hole of said housing and having an end shaft extending therefrom being drivingly engaged with the first hole of said transmission cap, at least a planetary gear, which is arranged engaging said sun gear of the housing, said planetary gear having a corresponding axle rotatably mounted on said cover to support a corresponding planetary disc at one end thereof.

2. A rotation driven structure as claimed in claim 1, wherein the at least one sun gear formed on said housing comprises a pair of sun gears mounted thereon having different diameters and located at different altitudes;

and the at least one planetary gear is a plurality of planetary gears, each of the pair of sun gears engaging at least one of the plurality of planetary gears.

3. A rotation driven structure as claimed in claim 2, wherein the plurality of planetary gears comprises a first, second and third planetary gears, the first and second planetary gears being engaged with one of the pair of sun gears, the third planetary gear engaged with the other of the pair of sun gears.

* * * * *